US007209834B2

(12) United States Patent
El Askary

(10) Patent No.: US 7,209,834 B2
(45) Date of Patent: Apr. 24, 2007

(54) METHOD AND APPARATUS FOR ESTIMATING DISTANCE TO OR FROM A GEOLOGICAL TARGET WHILE DRILLING OR LOGGING

(75) Inventor: Said Abdel Galil El Askary, Cairo (EG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/067,147

(22) Filed: Feb. 25, 2005

(65) Prior Publication Data

US 2006/0195264 A1 Aug. 31, 2006

(51) Int. Cl.
*G01V 3/18* (2006.01)

(52) U.S. Cl. ..... 702/7; 702/9; 702/11

(58) Field of Classification Search ..... 702/6, 702/7, 9; 703/10; 175/45
See application file for complete search history.

(56) References Cited

U.S. PATENT DOCUMENTS 4,601,353 A 7/1986 Schuh et al.
4,786,874 A 11/1988 Grosso et al.
5,389,881 A 2/1995 Bittar et al.
5,495,174 A 2/1996 Rao et al.
RE35,386 E * 12/1996 Wu et al. ..... 175/45
5,812,068 A * 9/1998 Wisler et al. ..... 340/855.5
5,842,149 A * 11/1998 Harrell et al. ..... 702/9
6,388,947 B1 * 5/2002 Washbourne et al. ..... 367/73
6,594,584 B1 * 7/2003 Omeragic et al. ..... 702/9
2004/0138819 A1 * 7/2004 Goswami et al. ..... 702/10
2004/0154831 A1 * 8/2004 Seydoux et al. ..... 175/24
2004/0245016 A1 * 12/2004 Chemali et al. ..... 175/25

* cited by examiner

*Primary Examiner*—Donald McElheny, Jr.
(74) *Attorney, Agent, or Firm*—Browning Bushman P.C.

(57) ABSTRACT

A system and method estimates the distance between a borehole and a subsurface boundary of interest in a geophysical region. In one embodiment, available existing sensor data for the geophysical region is used to create a resistivity model of the region, with the model reflecting changes in resistivity across the boundary. A hypothetical borehole has a number of segments along its length that are spaced-apart from the boundary by different, preselected distances. The ratio between two selected resistivity curves in each of the respective spaced-apart segments is computed, and these ratio values are plotted as a function of distance from the boundary. A curve-fitting algorithm is applied to derive an equation, which may be applied to actual sensor data from a sensor package.

21 Claims, 6 Drawing Sheets

METHOD AND APPARATUS FOR ESTIMATING DISTANCE TO OR FROM A GEOLOGICAL TARGET WHILE DRILLING OR LOGGING

FIELD OF THE INVENTION

This invention relates generally to the field of hydrocarbon exploration and production, and more particularly relates to the surveying of boreholes.

BACKGROUND OF THE INVENTION

In hydrocarbon exploration and production, for a wellbore to be deemed successful, it is important for the operator to have knowledge of exactly how far the wellbore is from certain geological features of interest, either above or below the wellbore itself.

Due to geological and petrophysical complexities, relying purely on the measurements from conventional logging devices provides little or no quantitative estimates of the distance of the wellbore from features of interest. This can result in the wellbore exiting or missing the targets that have been determined for the wellbore. This problem is even more pronounced for smaller targets.

In recent years, there has been a substantial increase in the drilling of "horizontal" wells. Such wells often have much greater productivity than the more standard "vertical" wells. It is well known in the art that these "horizontal" wells are not necessarily horizontal but rather have boreholes which follow within the boundaries of a producing subsurface zone which deviates from horizontal to some degree.

In the process of drilling such a borehole, it becomes necessary to guide the drill bit so that the borehole does not leave the boundaries of the subsurface producing zone. A boundary of a producing zone may be established by various non-oil bearing formations or it may be established by such borders as the oil-water contact level in the same producing formation. In order to avoid these boundaries and stay within the producing formation, means have been developed in the prior art, with varying success, to detect and subsequently avoid the various boundary stratum.

Two methods for detecting a boundary stratum are illustrated, respectively, in U.S. Pat. Nos. 4,786,874 and 4,601,353. Each of these methods employs a directionally focused sensor. One method generally describes a directionally focused gamma ray tool and the other method describes a directionally focused resistivity tool. These tools show a change in sensor readings as a boundary stratum is approached. The drill string may then be rotated as necessary to determine the position of the boundary stratum by the variation in magnitude of the sensor readings. Once the position of the boundary stratum is known, the driller can orient the bit to drill away from the boundary stratum.

In some cases, while drilling through horizontal producing zones, the driller's main concern may be with the oil-water contact boundary stratum rather than other boundary stratum on the sides of or above the producing zone. The driller may wish to keep the borehole a certain distance above the oil-water contact level so as to maximize the productive life of the well. Also, the driller will probably not want to turn upwards unnecessarily. In such a case, the driller does not necessarily need a directionally focused sensor to tell him in which direction the boundary stratum is located because he already has reasonable certainty that the boundary stratum lays below the present borehole path. In fact, if the motor type drilling assembly is being used, due to the occasional necessity to change the direction of the bit, a tool with a directionally focused sensor may be focused in the wrong direction to indicate the approach of an oil-water contact boundary stratum and therefore be unreliable. Moreover, the need to reorient the tool may create undesirable drilling operations.

At one time, the prior art provided no effective or acceptable method for calculating the approximate angle or dip of an approaching boundary stratum, even though it was recognized that such information would generally be useful to the driller for various reasons. It might affect the degree of turn the driller wishes to achieve. The driller will generally desire to make the borehole as straight as possible and avoid making relatively sharp turns for such reasons as given above. Normally, the driller will want to make no more of a turn than is necessary to avoid the boundary stratum.

To address these needs, it has been proposed in the prior art to utilize methods and apparatuses capable of taking resistivity measurements at multiple or variable depths of investigation. Those of ordinary skill in the art will understand the term "depth of investigation" as applied to resistivity measurements to refer to measurements of formation resisitivity at multiple or variable radial distances from the longitudinal axis of the borehole. Numerous examples of such methods and apparatuses have been proposed in the prior art, The use of a logging tool capable of taking multiple or variable depth of investigation resistivity measurements to adjust the direction of drilling to maintain a drill string within a region of interest, especially in the context of "horizontal" or "directional" drilling, is described in detail in U.S. Pat. No. 5,495,174 to Rao and Rodney, entitled "Method and Apparatus for Detecting Boundary Stratum and Adjusting the Direction of Drilling to Maintain the Drill String Within a Bed of Interest." Resistivity sensing at multiple depths of investigation is also described in detail in U.S. Pat. No. 5,389,881 to Bittar and Rodney, entitled "Well Logging Method and Apparatus Involving Electromagnetic Wave Propagation Providing Variable Depth of Investigation by Combining Phase Angle and Amplitude Attenuation."

Despite the technological advancements in the prior art, as exemplified by the referenced Rao et al. '174 patent and/or the Bittar et al. '881 patent, there continues to be a need for improvements in techniques for detecting the approach of boundary stratum, especially while drilling horizontal wells, which will result in greater reliability and dependability of operation. In particular, while the prior art includes examples of techniques useful for determining, to some degree of approximation, relative proximity of a borehole to a geophysical boundary, there have not been shown effective means or methods for quantifying the distance between a borehole and a geophysical boundary.

BRIEF DESCRIPTION OF THE DRAWINGS

Various features and aspects of the present invention will be best understood with reference to the following detailed description of a specific embodiment of the invention, when read in conjunction with the accompanying drawings, wherein.

DETAILED DESCRIPTION OF SPECIFIC EMBODIMENTS OF THE INVENTION

In the disclosure that follows, in the interest of clarity, not all features of actual implementations are described. It will of course be appreciated that in the development of any such actual implementation, as in any such project, numerous engineering and technical decisions must be made to achieve the developers' specific goals and subgoals (e.g., compliance with system and technical constraints), which will vary from one implementation to another. Moreover, attention will necessarily be paid to proper engineering and programming practices for the environment in question. It will be appreciated that such a development effort might be complex and time-consuming, but would nevertheless be a routine undertaking for those of ordinary skill in the relevant fields.

Furthermore, for the purposes of the present disclosure, the terms "comprise" and "comprising" shall be interpreted in an inclusive, non-limiting sense, recognizing that an element or method step said to "comprise" one or more specific components may include additional components.

In this description, the terms "up" and "down"; "upward" and downward"; "upstream" and "downstream"; and other like terms indicating relative positions above or below a given point or element are used in this description to more clearly described some embodiments of the invention. However, when applied to apparatus and methods for use in wells that are deviated or horizontal, such terms may refer to a left to right, right to left, or other relationship as appropriate.

Figure 1:
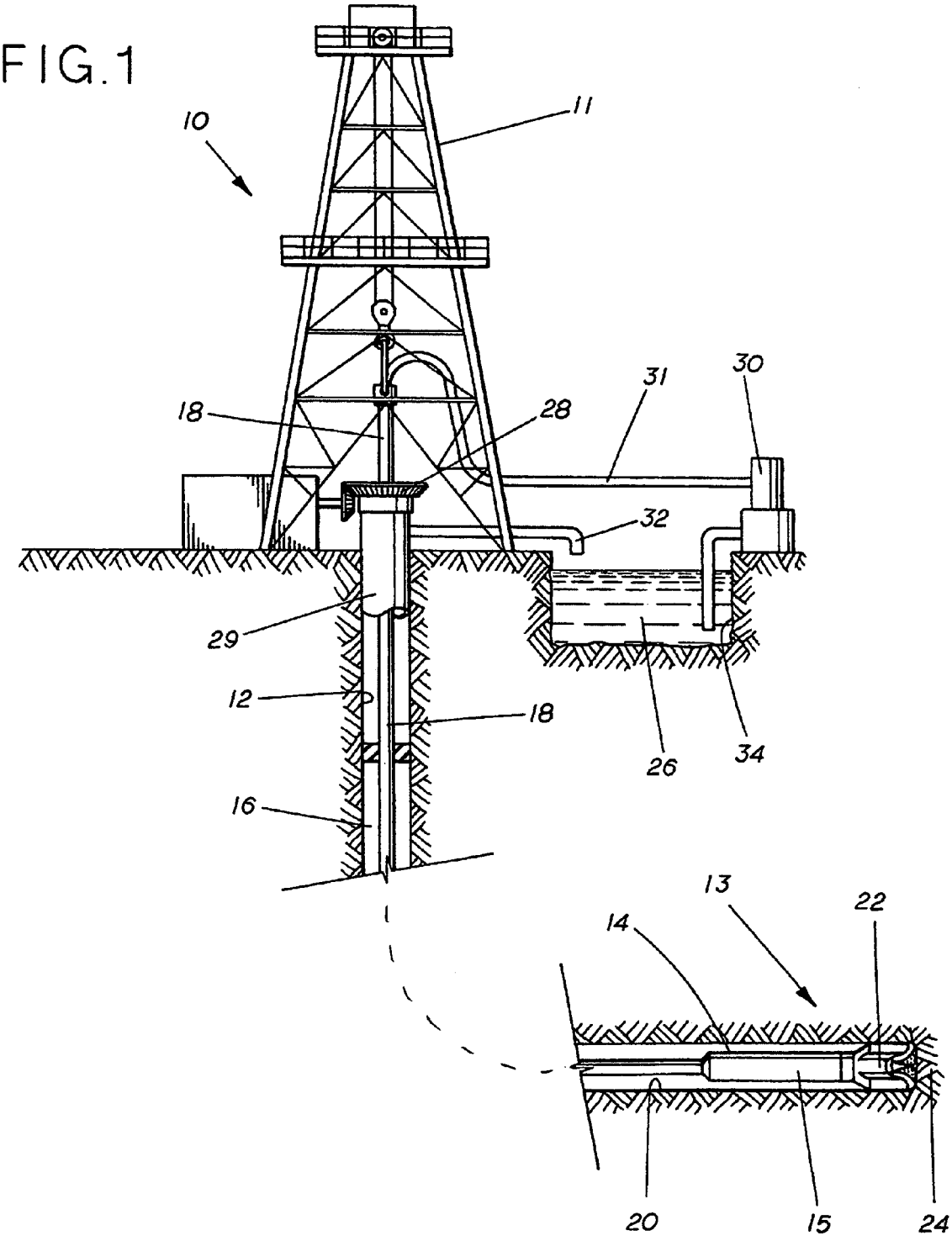
FIG. 1 is an illustration of a drilling rig for which the present invention may be utilized to control the trajectory of a borehole.

Referring to FIG. 1, there is shown a drilling rig 11 disposed on top of a borehole 12, a segment 13 of which shown when the borehole has been steered or directed to a substantially horizontal trajectory. A system 10 for dielectric constant and/or resistivity (conductivity) logging is carried by a sonde or sub 14 comprising a portion of a drill collar 15 and is disposed within the drill string 18 while the drilling operations are in progress.

A drill bit 22 is disposed at the lower end of drill string 18 and carves the borehole 12 out of the earth formations 24 while drilling mud 26 is pumped from the wellhead 28. Metal surface 29 casing is shown positioned in the borehole 12 above the drill bit 22 for maintaining the integrity of the borehole 12 near the surface. The annulus 16 between the drill string 18 and the borehole wall 20 creates a theoretically closed return mud flow path. Mud is pumped from the wellhead 28 by a pumping system 30 through mud supply line 31 coupled to the drill string 18. Drilling mud is, in this manner, forced down the central axial passageway of the drill string 18 and egresses at the drill bit 22 for carrying cuttings comprising the drilled sections of earth, rock and related matter upwardly from the drill bit to the surface. A conduit 32 is supplied at the wellhead for channeling the mud from the annulus 16 to a mud pit 34. The drilling mud is typically handled and treated at the surface by various apparatus (not shown) such as outgassing units and circulation tanks for maintaining a selected viscosity and consistency of the mud. The present logging system permits the measurement, for example, of formation resistivity in the regions surrounding the borehole during the pumping of drilling fluid through the drill string and borehole.

As shown in FIG. 1, the sub 14 and drill collar 15 comprise a portion of the formation resistivity logging system 10 of the present invention and the downhole environment. The system 10 is constructed to generate a series of signals for telemetry to the wellhead or a downhole recording system the signals of which are indicative of the formation resistivity of the earth formations adjacent to the borehole. The requisite telemetry and analysis systems are deemed to be of conventional design and are not specifically set forth or addressed herein other than in general terms. The method and apparatus for measurement of formation resistivity is, however, described in detail below and is a subject of the present invention.

Figure 2:
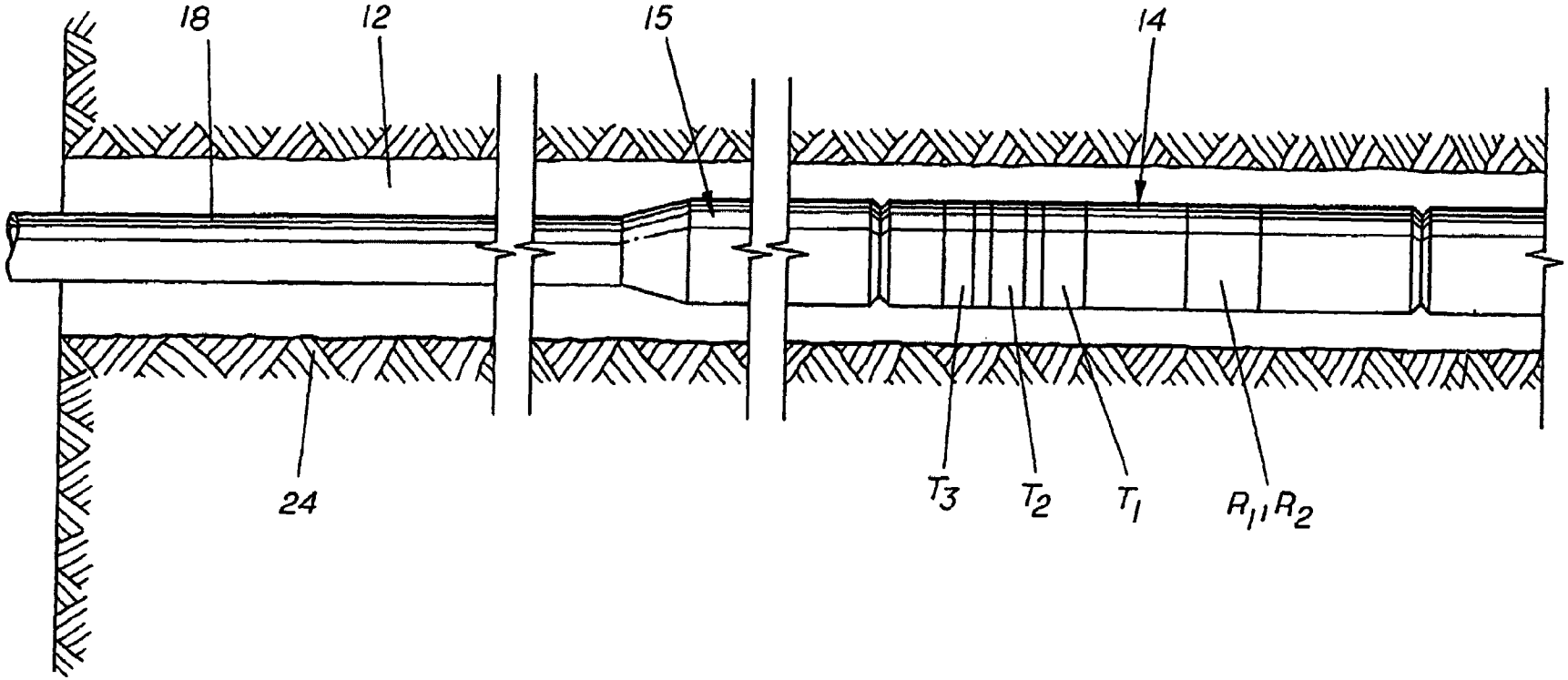
FIG. 2 is an illustration of a segment of a borehole made by the rig of FIG. 1, showing a resistivity sensor package therein.

Referring now to FIG. 2, there is illustrated in more detail the logging tool 14 in accordance with the present invention. The drill string includes one or more drill collars 15. A transmitter section comprised of transmitters $T_1$, $T_2$ and $T_3$ spaced along the length of the logging tool 14 is spaced from a receiver section that includes a pair of receivers, sometimes referred to herein as $R_1$ and $R_2$. When using transmitter frequencies which are different, for example, 2 MHz and 1 MHz, one can, if desired, use a pair of coils in each receiver, one tuned to 2 MHz and one tuned to 1 MHz. Each pair of such coils in a receiver can, if desired, be laid side by side around the periphery of the tool 14, or can be concentrically stacked. The transmitters $T_1$, $T_2$ and $T_3$, respectively, are covered over with a nonconductive material as is well known in the prior art. Likewise, the receiver section having receivers $R_1$ and $R_2$ is covered over with a non-conductive material. The transmitters and receivers can be fabricated and operated in accordance with teachings of U.S. Pat. No. 4,940,943, the above-referenced Rao et al. '174 patent, and/or the above-referenced Bittar et al. '881 patent, each commonly assigned to the assignee of the present invention. It should be appreciated that the body of tool 14 is preferably made of steel in order to prevent the tool 14 from becoming a weak link in the drill string 18.

It should be appreciated that the logging tool 14 also has the requisite electronic circuitry (not shown) for processing the signals received by the receivers $R_1$ and $R_2$ in accordance with the present invention, thereby converting the received signals into a log or another indication of formation resistivity as a function of location in the borehole. It should also be appreciated that the processed signals can be recorded within the electronics section of the tool 14 or may be fed by a conventional telemetry system (not illustrated) to the surface for concurrent processing and readout at the surface. Typical of such a well known telemetry system is one which generates mud pulses which can be detected at the earth's surface and which are indicative of the processed signals, which in turn are recorded as a function of depth in the borehole, all of which is conventional in the art.

Figure 3:
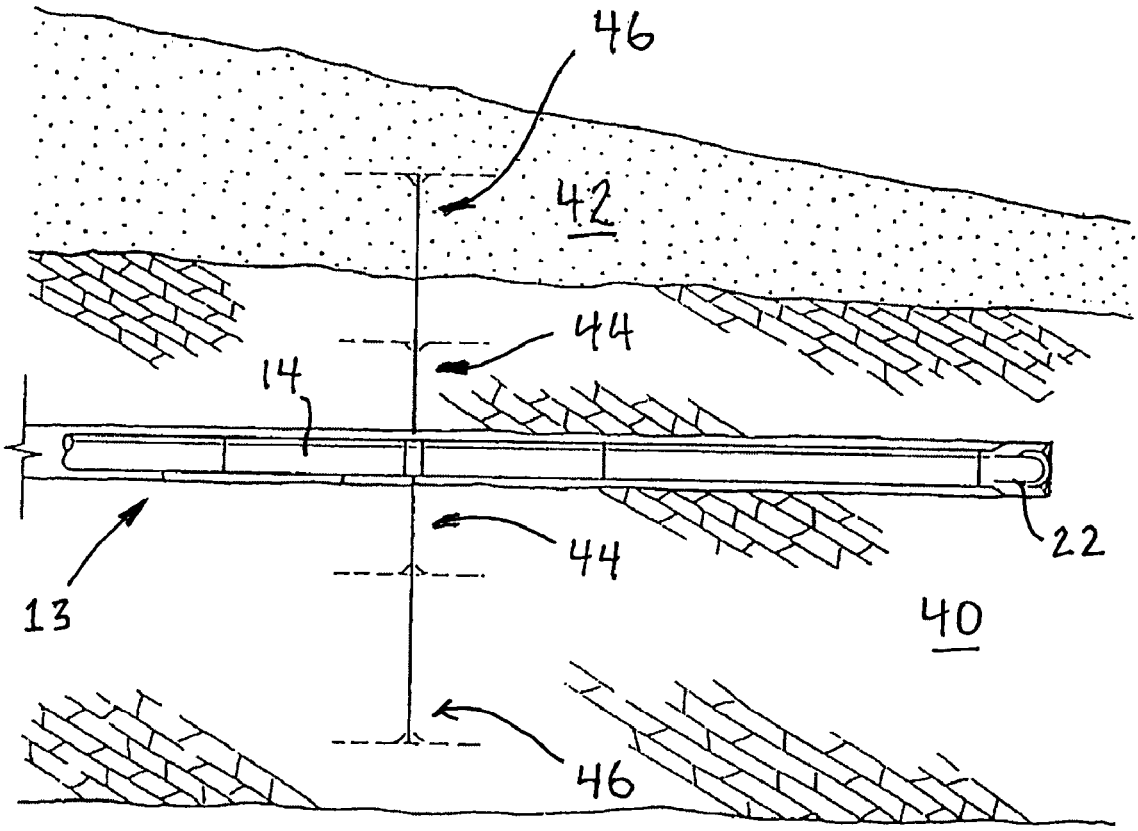
FIG. 3 is an illustration of the borehole segment of FIG. 2, showing a nearby boundary stratum between geophysical formations having different resistivity characteristics.

Turning to FIG. 3, there is shown a cutaway side view of horizontal borehole segment 13 passing through a producing zone 40 that is bounded by a boundary stratum 42. In the embodiment of FIG. 3, sensor tool 14 is capable of reading into the formation at two depths of investigation in borehole segment 13 within subsurface zone 40. In the particular situation shown in FIG. 3, deeper reading sensor 46 will be the first sensor to show some sensor reading variation due to the approach of geophysical boundary 42. That is, by assessing deeper sensor data relative to the less deep sensor data, the operator can perceive when the sensor is nearing the boundary 42. However, due to variations in the geophysical makeup of subsurface regions, the actual depths of investigation for the deeper sensor 46 and the less deep sensor 44 may not be known. The operator can perceive only in relative terms when the boundary 42 is within the depth of investigation of deeper sensor 46 and not within the depth of investigation of less deep sensor 44.

As the sensor tool 14 goes deeper, a less deep reading sensor 44 may confirm such signal. Since the sensor tool 14 will often be some distance "above" bit 22, the borehole 13 already drilled prior to the indication given by the deeper reading sensor 46 may continue close enough to boundary 42 for the less deep reading sensor 44 to confirm the signal given by the deeper reading sensor 46. Also, it may take a substantial amount of footage before the driller is able to effect a change in the trajectory of the borehole, thus leading to the possibility that bit 22 will undesirably cross into boundary stratum 42 before boundary stratum 42 is detected by the less deep sensor 44.

Figure 4:
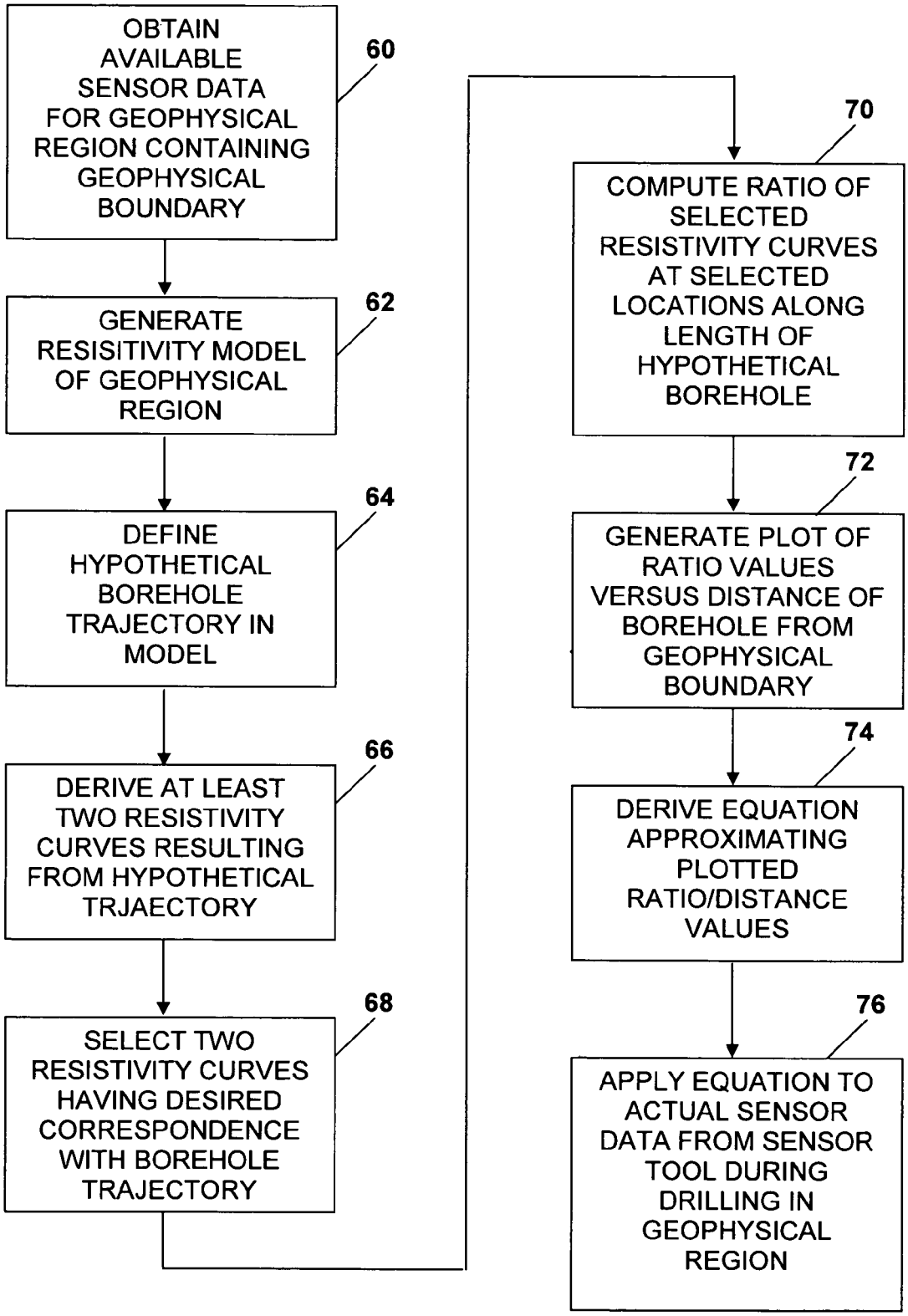
FIG. 4 is a flow diagram showing the steps involved in practicing an embodiment of the present invention to control the trajectory of a borehole.

A method of operating system 10 in accordance with the presently disclosed embodiment of the invention is illustrated in the flow diagram of FIG. 4. As shown in FIG. 4, the process begins with the acquisition of available data for the geophysical region through which a borehole is to pass, as represented by block 60 in FIG. 4. The invention is especially (although not exclusively) beneficial in the context of planned horizontal or directional drilling, where the borehole trajectory does not merely extend vertically downward beneath drilling rig 11, but rather travels some horizontal distance away from rig 11, as represented by borehole segment 13 in FIG. 1.

In such cases, it is not uncommon for the drilling operator to have available to it geophysical data about the formations which exist at areas horizontally distant from the rig 11. For example, the drilling operator may drill one or more so-called vertical offset wells (or may these have already been drilled by others) in the vicinity of a horizontal drilling site, and sensor data obtained from such drilling can be used to characterize the geophysical region.

Having obtained available resistivity data, the next step is to generate a resistivity model of the geophysical region. Such modeling, typically performed using conventional custom or off-the-shelf computer applications, is a common practice in the art, and the details of this process are believed to be well within the scope of knowledge of those of ordinary skill in the art.

In the presently disclosed embodiment, the resistivity model reflects various subterrainean features present in the geophysical region and the differing resistivity characteristics of those features. Using the example of FIG. 3, it is likely to be the case that the producing region 40 will have a different resistivity relative to surrounding regions, such as boundary stratum 42.

Figure 5:
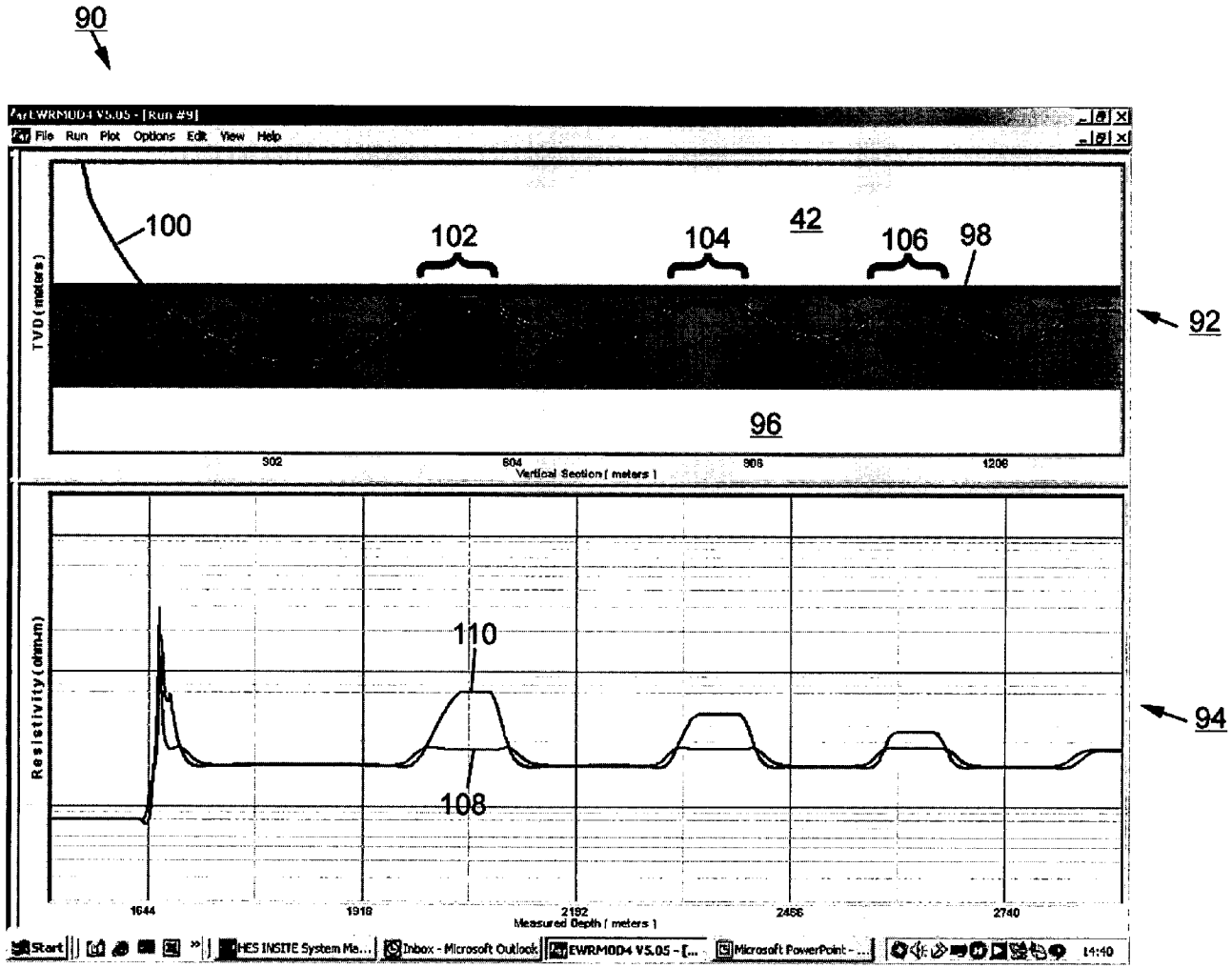
FIG. 5 is an illustration of a display of a computer model of a geophysical region having a boundary stratum therein, with a hypothetical borehole defined therein and the resulting resistivity sensor readings that would be obtained based upon available resistivity sensor data for the geophysical region.

FIG. 5 is a graphical representation of a resistivity model 90 in accordance with one embodiment of the invention. In the disclosed embodiment, the display depicted in FIG. 5 is presented to a user on a graphics screen, such as that of a computer running an appropriate modeling application, as would be familiar to those of ordinary skill in the art.

The display of FIG. 5 comprises two separate areas: a first area 92 in which is depicted the physical orientation of the known geophysical structures present in the geophysical region of interest, and a second area 94 in which a plot of modeled or measured resistivity along the region, as will be hereinafter described in further detail.

As depicted in the structural area 92 in FIG. 5, the geophysical region comprises a producing region 40 and an upper boundary stratum 42, as previously described with reference to FIG. 3. There may also be a lower boundary stratum 96 below producing region 40, as depicted in FIG. 5.

The horizontal axis in areas 92 and 94 corresponds to "depth," i.e., distance into the borehole, which in the present example happens to extend substantially horizontally. In area 42, the vertical axis corresponds to the physical dimensions of the structures 40, 42, and 96. In the hypothetical embodiment of FIG. 5, it is assumed that the different structures in the overall geophysical region have different resistivity characteristics. For example, the producing region 40 may have an average resisitivity of 2Ω per meter and boundary stratum 42 may have an average resistivity of 0.8Ω per meter. Further, as would be appreciated by those of ordinary skill in the art, it may be the case that the interface between regions 40 and 42, designated by line 98 in FIG. 5, may itself have a sensed resisitivity which differs from the resistivities of regions 40 and 42, for example, 10.0Ω per meter.

Turning again to FIG. 4, the next step, represented by block 64, is to define a hypothetical borehole in the trajectory model. Once again, those of ordinary skill in the art will appreciate that the various well-known computer-based seismic data modeling and manipulation applications commonly used in the industry.

The hypothetical borehole trajectory is defined to have certain desired characteristics. In particular, the hypothetical borehole is defined such that at various points along its length, it passes within a specified distance from a feature of interest in the geophysical region, in one embodiment, this feature of interest being a boundary between two geophysical structures in the region.

Retuning to FIG. 5, in the presently disclosed embodiment, a hypothetical borehole 100 is shown. In area 94, there is shown a plot of resistivity sensor readings that would be expected to be observed based on the model derived from the known seismic data for the geophysical region. That is, based on the known data for the region, the plot in area 94 represents what a resistivity sensor tool would produce were borehole 100 actually drilled.

Those of ordinary skill in the art will appreciate that a typical resistivity sensor tool often carries multiple individual resistivity sensors or sensor arrays calibrated to provide resistivity sensor signals corresponding to multiple depths of investigation (or a single sensor array capable of producing sensor signals corresponding to more than one depth of investigation. Further, it is common in the art for a resistivity sensor to provide sensor output consisting of a resistivity phase signal and a resistivity amplitude signal. Consequently, a typical resistivity survey results in generation of a plurality of resistivity signals. This is reflected by block 66 in FIG. 4, which comprises the step of deriving a plurality (e.g., at least two) resistivity curves resulting from the trajectory of hypothetical borehole 100 based on the available resistivity data for the region.

In FIG. 5, only two resistivity sensor curves, designated with reference numerals 108 and 110, are shown. These curves represent a selection from among the collection of available sensor data for the geophysical region which have a desired degree of correlation with the trajectory of borehole 100, as will be hereafter described in further detail.

As can be seen in FIG. 5, at certain points along its length, hypothetical borehole 100 is defined to include a number of segments which approach boundary 98, in each case, such segments closing in to a different preselected distance away from boundary 98. In particular, it can be observed in FIG. 5 that borehole 100 has segments which extend parallel to boundary 98 at three locations, designated generally with reference numerals 102, 104, and 106, respectively. In the exemplary embodiment, borehole 100 at segment 102 is 30 centimeters from boundary 98, 50 centimeters from boundary 98 at segment 104, and 100 centimeters from boundary 98 at segment 106.

As borehole 100 makes the excursions to within predetermined distances away from boundary 98 at segments 102, 104, and 106, one can observe corresponding excursions in the modeled resistivity plots shown in area 94 of display 90. As shown in FIG. 5, the magnitude of these excursions will vary depending upon the types of sensors used in compiling the sensor data for the region, the different depths of investigation corresponding to these sensors, and so on. As noted above, there are typically several different sensor datasets available when resistivity sensing is performed, such that hypothetical borehole 100 will typically result in a corresponding number of different resistivity sensor plots.

Consequently, as represented by block 68 in FIG. 4, the next step in the process according to the presently disclosed embodiment of the invention is to select two resistivity plots that have a desired degree of correlation with the trajectory of borehole 100. This is what is shown in area 94 in the display 90 of FIG. 5.

As can be seen in FIG. 5, the magnitude of excursions in resistivity plot 110 are noticeably greater than those in resistivity plot 108, at each of segments 102, 104, and 106. As noted above, this may be due to many factors, including the type(s) of sensor(s) used, the depth(s) of investigation for the sensor(s) and so on.

As described above, the various excursions of borehole 100 toward boundary 98 preferable correspond to a progession of distances away from boundary 98, for example, 30 centimeters, 50 centimeters, and 150 centimeters, respectively, for segments 102, 104, and 106. Because of these differences in the proximity of borehole 100 from boundary 98 at the respective segments 102, 104, and 106, one can observe that the differences in the magnitudes of the excursions in waveforms 108 and 110 are correspondingly different as well. The excursions in resistivity waveforms such as those in waveforms 108 and 110 in FIG. 5 are generally indicative of the borehole coming into proximity of a boundary characterized by a change in resistivity. However, it is generally not possible to establish a correlation between the magnitude of excursions in a single resistivity waveform and the actual distance between a borehole and the boundary. That is, the excursions give the drilling operator a general indication that the borehole is near a boundary, but does not give the drilling operator a quantification of the actual distance away from the boundary.

In recognition of this limitation of prior art methodologies, a next step in the process outlined in FIG. 4 is to compute ratios between the two selected resisitivity curves 108 and 110 at each of segments 102, 104, and 106. This is represented by block 70 in FIG. 4.

As a purely hypothetical example, one might find in performing step 70 that the ratio between the magnitude of waveform 108 and the magnitude of waveform 110 at segment 102, where borehole 100 is 30 centimeters away from boundary 98 is 1:3, while the ratio between the magnitudes of waveforms 108 and 110 at segment 104, where borehole 100 is 50 centimeters away from boundary 98 is 1:2, and the ratio between the magnitudes of waveforms 108 and 110 at segment 106, where borehole 100 is 150 centimeters from boundary 98 is 3:2.

Figure 6:
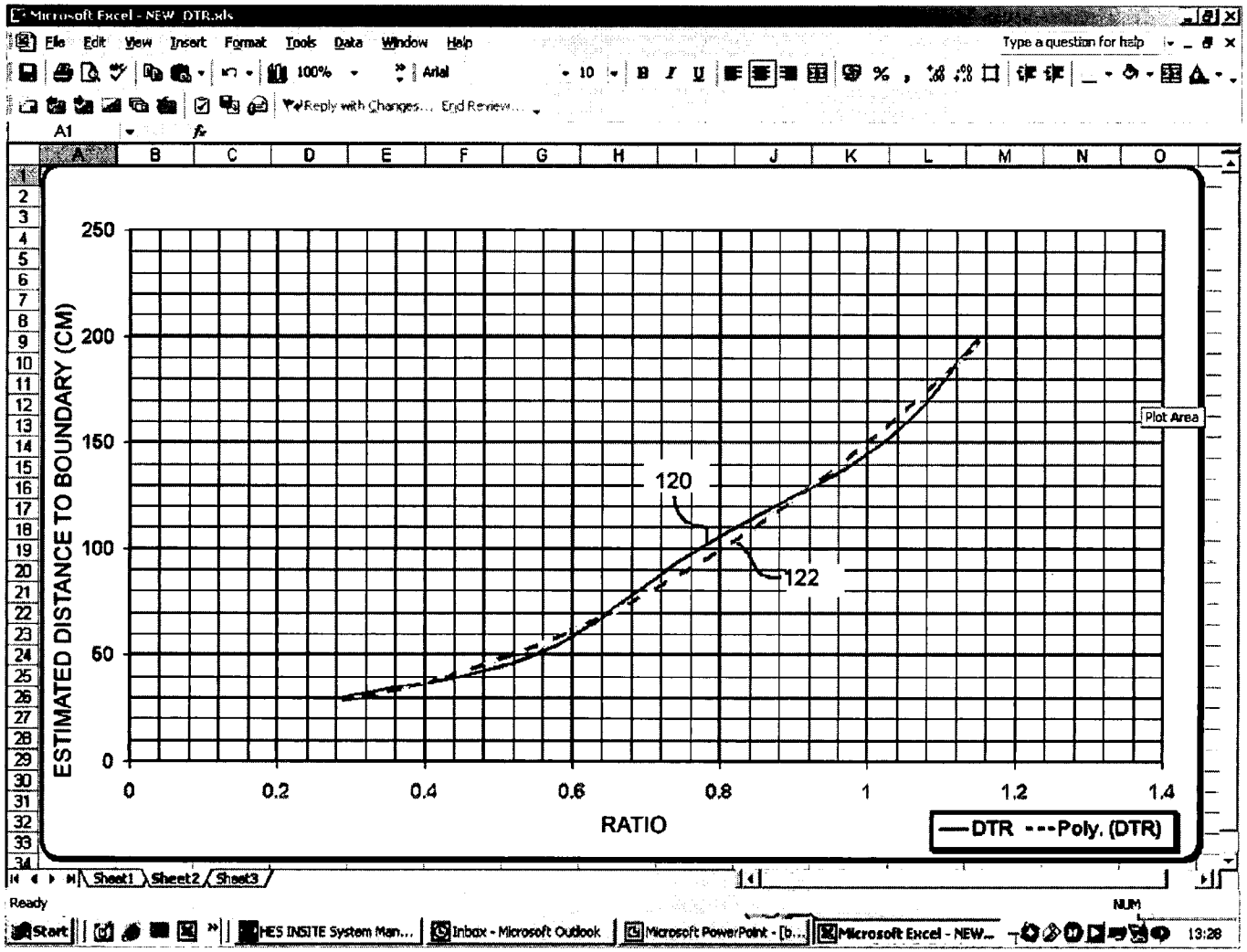
FIG. 6 is a plot of resisitivity sensor ratios versus distance from a boundary.

Once these ratios are computed, the next step is to plot these ratios as a function of distance between borehole 100 and boundary 98. Turning to FIG. 6, this is represented by solid plot 120. In FIG. 6, ratio values are plotted along the horizontal axis, and distance to boundary, in centimeters, is plotted along the vertical axis.

Next, as represented by block 74 in FIG. 4, an equation is derived to describe, to an acceptable level of approximation, the ratio/distance curve reflected in the data. As would be understood to those of ordinary skill in the art, any one of a number of known "curve fitting" methods can be used derive the equation, for example, a polynomial least-squares approximation or the like. This equation, plotted as dashed waveform 122 in FIG. 6, closely approximates the actual data 120.

The equation derived in step 74 in FIG. 4 comprises a function which relates the readings from the two sensors selected in step 68 (or, more precisely, the ratio between these two sensor readings), as input values, to an estimated distance from a boundary, as an output value.

Those of ordinary skill in the art will appreciate, as represented by block 76 in FIG. 4, that the equation derived in step 74 can be used during actual drilling in the geophysical region modeled in step 62 to provide a reliable estimate of the distance from the borehole being drilled from boundary 98. This is done by obtaining readings from the sensors corresponding to the two waveforms 108 and 110 selected in step 68 and using these readings as input values to the equation derived in step 74. By so doing, the drilling operator is beneficially provided not merely a general indication that the borehole is relatively near to the boundary 98, but a quantified estimate of the actual distance from the boundary 98.

Those of ordinary skill in the art will appreciate that the process described herein is preferably implemented as a computer-based system. For example, the data modeling function which results in the display depicted in FIG. 5 is preferably accomplished using a conventional data modeling application executed by a computer, such as a conventional Microsoft® Windows®-based computer system or an equivalent thereof, as would be quite familiar to those of ordinary skill in the art. Such a computer system preferably has the usual complement of peripheral devices, including, without limitation, a display, user input devices (mouse, keyboard, etc . . . ) and so on. Details of implementation of such computer systems are not considered necessary for the purposes of appreciating the present invention, and it is believed that those of ordinary skill in the art having the benefit of the present disclosure will be able to implement a system with the necessary computational and user-interaction capabilities to practice the invention as a matter of routine engineering.

Likewise, implementation of the necessary modeling applications and associated computational applications, such as an application for computing ratios between sensor signal data and for "curve fitting" to plotted data would be a matter of routine programming to those of ordinary skill in the art, to the extent that such applications are not already commercially available.

From the foregoing detailed description of specific embodiments of the invention, it should be apparent that systems and methods for estimating the distance to or from a feature of interest while drilling or logging have been disclosed. Although specific embodiments and variations of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested in the present disclosure, may be made to the disclosed embodiments without departing from the spirit and scope of the invention as defined by the appended claims, which follow.

What is claimed is:

1. A method for estimating distance between a borehole and a subterranean geophysical boundary within a geophysical region, comprising:

defining a resistivity model of the resistivity characteristics of said geophysical region based on available resistivity data for said region;

defining a hypothetical borehole having a trajectory extending through said geophysical region, said hypothetical borehole trajectory at a plurality of discrete locations along the length of the borehole being spaced apart from said geophysical boundary by a plurality of selected distances;

deriving from said resistivity model a plurality of hypothetical resistivity sensor values each corresponding to one of said plurality of discrete locations along said hypothetical borehole;

deriving an equation approximating a mathematical relationship between said plurality of resisitivity sensor values and said plurality of selected distances;

wherein said equation defines a relationship between actual resistivity sensor data and quantified estimates of distance between an actual borehole and said geophysical boundary.

2. A method in accordance with claim 1, wherein said resistivity model evidences a change in resistivity at said geophysical boundary.

3. A method in accordance with claim 1, wherein each of said plurality of hypothetical resisitivity sensor values comprises a ratio between a resisitivity phase value and a resistivity amplitude value when said hypothetical borehole trajectory is one of said plurality of predefined distances away from said geophysical boundary.

4. A method in accordance with claim 1, wherein said plurality of discrete locations along the length of said borehole comprises at least two discrete locations.

5. A method in accordance with claim 4, wherein said plurality of selected distances comprises distances ranging from less than one-half meter and as great as one and one-half meters.

6. A method in accordance with claim 1, wherein said available resistivity data is obtained from prior drilling in said geophysical region.

7. A method in accordance with claim 1, wherein said deriving an equation comprises deriving a polynomial approximation of a relationship between said plurality of hypothetical sensor values and said plurality of predefined distances.

8. A method in accordance with claim 3, wherein said available resistivity data includes data sets corresponding to at least two depths of investigation.

9. A method in accordance with claim 8, further comprising selecting said resistivity phase value from a data set corresponding to a first depth of investigation and selecting resistivity amplitude value from a data set corresponding to a second depth of investigation.

10. A method for estimating distance between a borehole and a subterranean geophysical boundary within a geophysical region, comprising:

defining a resistivity model of the resistivity characteristics of said geophysical region based on available resistivity data for said region;

defining a hypothetical borehole having a trajectory extending through said geophysical region, said trajectory being such that the distance between said hypothetical borehole and said geophysical boundary varies along the length of said hypothetical borehole;

deriving at least two hypothetical resistivity sensor curves corresponding to said trajectory and said resistivity model;

selecting two of said at least two hypothetical resistivity sensor curves having a desired correlation with said trajectory's distance from said geophysical boundary;

computing ratios between said selected two hypothetical resisitivity sensor curves at a plurality of points along said trajectory;

deriving an equation approximating a mathematical relationship between said computed ratios and distances from said geophysical boundary at said plurality of points;

said equation being applicable to actual resistivity sensor values from a downhole sensor tool to permit estimation of actual distance of a borehole from said geophysical boundary.

11. A method in accordance with claim 10, wherein said at least two hypothetical resistivity sensor curves comprise at least one resistivity amplitude curve and at least one resistivity phase curve.

12. A method in accordance with claim 10, wherein said resistivity model evidences a change in resistivity at said geophysical boundary.

13. A method in accordance with claim 10, wherein said available resistivity data is obtained from prior drilling in said geophysical region.

14. A method in accordance with claim 10, wherein said deriving an equation comprises deriving a polynomial approximation of a relationship between said plurality of hypothetical sensor values and said plurality of predefined distances.

15. A method in accordance with claim 10, wherein said available resistivity data includes data sets corresponding to at least two depths of investigation.

16. A method in accordance with claim 15, wherein said selecting two hypothetical resistivity curves comprises selecting a resistivity curve corresponding to a first depth of investigation and selecting a resistivity curve corresponding to a second depth of investigation.

17. A machine-readable medium that provides instructions, which when executed by a machine, cause said machine to perform the method of any of claims 1 through 16.

18. A computer-based system for estimating the distance between a borehole in a geophysical region having a boundary therein between formations having different resistivity characteristics, comprising:

a modeling application, executed by a computer, for generating a resistivity model of said geophysical region based on existing sensor data from said geophysical region;

a user input mechanism for defining a hypothetical borehole in said resistivity model;

a display device for displaying a plurality of resistivity curves corresponding to hypothetical borehole;

a first computation application, executed by said computer, for computing ratios between a selected two of said resistivity curves at a plurality of selected locations along the length of said hypothetical borehole;

a second computation application, executed by said computer, for plotting said ratios as a function of distance of said hypothetical borehole from said boundary;

a curve-fitting application, executed by said computer, for deriving an equation defining a correlation between the ratio between said selected two resistivity curves and distance from said boundary.

19. A system in accordance with claim 18, wherein said hypothetical borehole has at least one segment that is spaced-apart from said boundary by a preselected distance.

20. A system in accordance with claim 19, wherein said hypothetical borehole has at a first segment that is spaced-apart from said boundary by a first preselected distance and a second segment that is spaced-apart from said boundary by a second preselected distance greater than said first preselected distance.

21. A system in accordance with claim 20, wherein said first computation application computes a ratio between said selected two resistivity curves in said first segment and said second segment.

* * * * *